US006351077B1

(12) United States Patent
Koyama

(10) Patent No.: US 6,351,077 B1
(45) Date of Patent: Feb. 26, 2002

(54) EL DISPLAY DEVICE AND DRIVING METHOD THEREOF

(75) Inventor: Jun Koyama, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 09/664,173

(22) Filed: Sep. 19, 2000

(30) Foreign Application Priority Data

Sep. 24, 1999 (JP) ..... 11-271366

(51) Int. Cl.[7] ..... G09G 3/10

(52) U.S. Cl. ..... 315/169.3; 345/76; 345/89; 345/153; 345/155

(58) Field of Search ..... 315/169.3, 169.2, 315/169.1; 345/76, 88, 89, 90, 153, 155

(56) References Cited

U.S. PATENT DOCUMENTS 5,990,629 A 11/1999 Yamada et al. ..... 315/169.3
6,157,396 A * 12/2000 Margulis et al. ..... 345/506
6,191,767 B1 * 2/2001 Mano et al. ..... 345/90

FOREIGN PATENT DOCUMENTS

JP 10-312173 11/1998

OTHER PUBLICATIONS

1 English abstract re Japanese Patent Application No. JP 10–214060, published Aug. 11, 1998.

2 English abstract re Japanese Patent Application No. JP 10–232649, published Sep. 2, 1998.

3 Full English translation re Japanese Patent Application No. JP 10–312173, published Nov. 24, 1998.

* cited by examiner

*Primary Examiner*—Haissa Philogene
(74) *Attorney, Agent, or Firm*—Cook, Alex, McFarron, Manzo, Cummings & Mehler, Ltd.

(57) ABSTRACT

The present invention is characterized by adding a bit having the value of one below the least significant bit of n bit digital data having red image information inputted from the external, adding a bit having the value of zero above the most significant bit of n bit digital data having green image information inputted from the external, and adding a bit having the value of zero above the most significant bit of n bit digital data having blue image information inputted from the external, whereby producing (n+1) bit digital data having red image information, (n+1) bit digital data having green image information, and (n+1) bit digital data having blue image information, respectively, for displaying an image.

10 Claims, 9 Drawing Sheets

EL DISPLAY DEVICE AND DRIVING METHOD THEREOF

BACKGROUND OF THE INVENTION

1. Field of the Invention

The present invention relates to a method of driving EL display device, a driving circuit for implementing the driving method, and an EL display device comprising the driving circuit.

2. Description of the Related Art

Techniques of forming a TFT (thin film transistor) on a substrate have been widely progressing in recent years, and development of applications thereof to an active matrix type display device are advancing. In particular, a TFT using a polysilicon film has a higher electric field effect mobility than a TFT using a conventional amorphous silicon film, and high speed operation is therefore possible. As a result, it becomes possible to perform pixel control, conventionally performed by a driving circuit external to the substrate, by the driving circuit formed on the same substrate as a pixel.

This type of active matrix display device has been in the spotlight because of the many advantages which can be obtained by incorporating various circuits and elements on the same substrate, such as reduced manufacturing cost, display device miniaturization, increased yield, and higher throughput.

Presently, active matrix EL display devices with EL elements as self-light-emitting elements are actively researched. An EL display device is also referred to as an organic EL display (OELD) or an organic light emitting diode (OLED).

Unlike a liquid crystal display device or the displays, an EL display device is of a self-light-emitting type. An EL element is structured such that an EL layer is sandwiched between a pair of electrodes. The EL layer typically has a laminated structure. A laminated structure of "a hole transporting layer/a light emitting layer/an electron transporting layer" proposed by Tang, et al. of Eastman Kodak Co. is a typical laminated structure. This structure has very high light emitting efficiency, and thus, most of EL display devices that are now under research and development adopt this structure.

Other than this, the laminated structure may be a hole injecting layer/a hole transporting layer/a light emitting layer/an electron transporting layer, or, a hole injecting layer/a hole transporting layer/a light emitting layer/an electron transporting layer/an electron injecting layer laminated in this order on a pixel electrode. A fluorescent pigment or the like may be doped in an EL layer.

When predetermined voltage is applied from a pair of electrodes to the EL layer structured as described in the above, recombination of carriers in the light emitting layer is caused to emit light. It is to be noted that light emission by an EL element may be herein referred to as driving of an EL element.

Color display methods of an EL display device are roughly divided into four: a method where three kinds of EL elements emitting R (red), G (green), and B (blue) light, respectively, are formed; a method where EL elements emitting white light are combined with a color filter of R, G, and B; a method where EL elements emitting blue or blue-green light are combined with a fluophor (fluorescent color conversion layer: CCM); and a method where EL elements corresponding to R, G, and B are superimposed on a transparent electrode used as a cathode (an opposing electrode).

Generally, the luminance of red light emission is lower than the luminance of blue and green light emission in many organic EL materials. When an organic EL material having such light emitting characteristics is used for an EL display device, the luminance of red in a displayed image is low. Further, since the luminance of red light emission is lower than the luminance of blue and green light emission, a method is conventionally adopted where orange light the wavelength of which is a little shorter than that of red light is used as red light. However, in this case also, the luminance of red itself of an image displayed on the EL display device is low, and an image which is intended to be displayed in red is displayed in orange. As a result, only a display device, which has unbalanced luminance of red, green, and blue light emission and unsatisfactory white balance, can be provided.

SUMMARY OF THE INVENTION

The present invention has been made in view of the above problems, and an object of the present invention is to provide a driving method and a driving circuit for realizing an EL display device with excellent white balance.

A method of driving an EL display device according to the present invention is now described. In the driving method according to the present invention, in view of the lower luminance of red light emission of the EL light emitting layer, by suppressing the luminance of a green image and the luminance of a blue image, the luminance of a red image, the luminance of a green image, and the luminance of a blue image are well-balanced, which makes it possible to improve the white balance. It is to be noted that the present invention can be applied not only to EL light emitting elements using an EL light emitting layer which emits white light and a color filter but also to EL light emitting elements using an EL light emitting layer which emits red light, an EL light emitting layer which emits green light, and an EL light emitting layer which emits blue light.

It is to be noted that here, for the sake of simplicity, a case where an original image signal inputted from the external is 6 bit digital data is described. First, reference is made to FIG. 1, which shows the luminance of red (R) light emission, the luminance of green (G) light emission, and the luminance of blue (B) light emission of EL light emitting elements with respect to gray-scale levels of the 6 bit digital data. It is to be noted that luminance of 64 ($=2^6$) gray-scale levels can be obtained from the 6 bit digital data. Further, it is to be noted that, though a case where 6 bit digital data is inputted is described herein, the driving method according to the present invention can also be applied to a case where n bit digital data is inputted (n is a natural number).

$B_{Rmax}$, $B_{Gmax}$, and $B_{Bmax}$ are the maximum values of the luminance of red light emission, the luminance of green light emission, and the luminance of blue light emission, respectively (here, in the case of 64 gray-scale levels). It is to be noted that, for the sake of convenience, a case where $B_{Gmax}=B_{Bmax}=2B_{Rmax}$ is assumed.

As shown in FIG. 1, when the gray-scale level is at maximum (64), the luminance of red light emission, the luminance of green light emission, and the luminance of blue light emission take the maximum values $B_{Rmax}$, $B_{Gmax}$, and $B_{Bmax}$, respectively. However, since the maximum value $B_{Rmax}$ of the luminance of red light emission is half of the maximum value $B_{Gmax}$ of the luminance of green light emission or half of the maximum value $B_{Bmax}$ of the luminance of blue light emission, if the display is carried out with them being as they are, the maximum luminance varies and the white balance is unsatisfactory.

FIGS. 2 and 3 are conceptual views of the method of driving an EL display device according to the present invention. In the method of driving an EL display device according to the present invention, n bit digital data having red, green, and blue image information (gray-scale information) are converted into (n+1) bit digital data, respectively. Here, a case where 6 bit digital data are converted into 7 bit digital data is described as an example. First, digital data conversion carried out in the driving method according to the present invention is described with reference to FIG. 3.

Data conversion of 6 bit digital data having red image information is shown in FIG. 3R, data conversion of 6 bit digital data having green image information is shown in FIG. 3G, and data conversion of 6 bit digital data having blue image information is shown in FIG. 3B.

First, data conversion of 6 bit digital data having red image information (gray-scale information) (FIG. 3R) is described. R0 (=1) is added below R1 that is the least significant bit among the 6 bit digital data (R6 (MSB), R5, R4, R3, R2, and R1 (LSB)) having red image information. In other words, R0 (=1) to serve as the least significant bit is added to the 6 bit digital data (R6 (MSB), R5, R4, R3, R2, and R1 (LSB)) having red image information. It is to be noted that the 6 bit digital data before the conversion (R6 (MSB), R5, R4, R3, R2, and R1 (LSB)) is used as the upper 6 bits of the 7 bit digital data after the conversion. In this way, the 6 bit digital data having red image information is converted into the 7 bit digital data in which the value of the least significant bit (LSB) is "1".

Next, data conversion of 6 bit digital data having green image information (gray-scale information) (FIG. 3G) is described. G7 (=0) is added above G6 that is the most significant bit among the 6 bit digital data (G6 (MSB), G5, G4, G3, G2, and G1 (LSB)) having green image information. In other words, G7 (=0) to serve as the most significant bit is added to the 6 bit digital data (G6 (MSB), G5, G4, G3, G2, and G1 (LSB)) having green image information. It is to be noted that the 6 bit digital data before the conversion (G6 (MSB), G5, G4, G3, G2, and G1 (LSB)) is used as the lower 6 bits of the 7 bit digital data after the conversion. In this way, the 6 bit digital data having green image information is converted into the 7 bit digital data in which the value of the most significant bit (MSB) is "0".

Next, data conversion of 6 bit digital data having blue image information (gray-scale information) (FIG. 3B) is described. The conversion of the 6 bit digital data having blue image information is similar to the conversion of the 6 bit digital data having green image information. B7 (=0) is added above B6 that is the most significant bit among the 6 bit digital data (B6 (MSB), B5, B4, B3, B2, and B1 (LSB)) having blue image information. In other words, B7 (=0) to serve as the most significant bit is added to the 6 bit digital data (B6 (MSB), B5, B4, B3, B2, and B1 (LSB)) having blue image information. It is to be noted that the 6 bit digital data before the conversion (B6 (MSB), B5, B4, B3, B2, and B1 (LSB)) is used as the lower 6 bits of the 7 bit digital data after the conversion. In this way, the 6 bit digital data having blue image information is converted into the 7 bit digital data in which the value of the most significant bit (MSB) is "0".

As described in the above, the respective red, green, and blue 6 bit digital ata are converted into 7 bit digital data.

By carrying out such digital data conversion, as shown in FIG. 2A, the digital data having red image information presents the lowest luminance (here, 0) at the lowest gray-scale level (here, gray-scale level 2), and presents the highest luminance $B_{Rmax}$ at the highest gray-scale level (here, gray-scale level 128). Display of 64 gray-scales from gray-scale level 2 to gray-scale level 128 can be carried out with two gray scale levels as one step and the luminance being from the lowest luminance to the highest luminance $B_{Rmax}$.

As shown in FIG. 2B, the digital data having green image information presents the lowest luminance (here, 0) at the lowest gray-scale level (here, gray-scale level 1), and presents the highest luminance $B_{Rmax}$ at the highest gray-scale level (here, gray-scale level 64). Here, the highest gray-scale level is 64 because the bit of the value of the most significant bit becomes "0" through the above-described digital data conversion. In this way, display of 64 gray-scales from gray-scale level 1 to gray-scale level 64 can be carried out with the luminance being from the lowest luminance to the highest luminance $B_{Rmax}$.

As shown in FIG. 2B, the digital data having blue image information presents the lowest luminance (here, 0) at the lowest gray-scale level (here, gray-scale level 1), and presents the highest luminance $B_{Rmax}$, at the highest gray-scale level (here, gray-scale level 64). Here, similarly to the case of green, the highest gray-scale level is 64 because the value of the most significant bit becomes "0" through the above-described digital data conversion. In this way, display of 64 gray-scales from gray-scale level 1 to gray-scale level 64 can be carried out with the luminance being from the lowest luminance to the highest luminance $B_{Rmax}$.

Therefore, all of the highest luminance of red, the highest luminance of green, and the highest luminance of blue are the highest luminance $B_{Rmax}$ of red, and thus, display can be carried out with the luminance of red, the luminance of green, and the luminance of blue being well-balanced.

Further, a general case where n bit digital data having red image information (gray-scale information), n bit digital data having green image information (gray-scale information), and n bit digital data having blue image information (gray-scale information) are respectively converted into (n+1) bit digital data is now described with reference to FIG. 7.

Data conversion of n bit digital data having red image information is shown in FIG. 7R, data conversion of n bit digital data having green image information is shown in FIG. 7G, and data conversion of n bit digital data having blue image information is shown in FIG. 7B.

First, data conversion of n bit digital data having red image information (gray-scale information) (FIG. 7R) is described. R0 (=1) is added below that is the least significant bit among the n bit digital data (Rn (MSB), Rn−1, . . . , R3, R2, and R1 (LSB)) having red image information. In other words, R0 (=1) to serve as the least significant bit is added to the n bit digital data (Rn (MSB), Rn−1, . . . , R3, R2, and R1 (LSB)) having red image information. It is to be noted that the n bit digital data before the conversion (Rn(MSB), Rn−1, . . . , R3, R2, and R1 (LSB)) is used as the upper n bits of the (n+1) bit digital data after the conversion. In this way, the n bit digital data having red image information is converted into the (n+1) bit digital data in which the value of the least significant bit (LSB) is "1".

Next, data conversion of n bit digital data having green image information (gray-scale information) (FIG. 7G) is described. Gn+1 (=0) is added above the most significant bit amount the n bit digital data (Gn (MSB), Gn−1, . . . , G3, G2, and G1 (LSB)) having green image information. In other words, Gn+1 (=0) to serve as the most significant bit is added to the n bit digital data (Gn (MSB), Gn−1, . . . , G3, G2, and G1 (LSB)) having green image information. It is to be noted that the n bit digital data before the conversion (Gn (MSB), Gn−1, . . . , G3, G2, and G1 (LSB)) is used as the lower n bits of the (n+1) bit digital data after the conversion. In this way, the n bit digital data having green image information is converted into the (n+1) bit digital data in which the value of the most significant bit (MSB) is "0".

Next, data conversion of n bit digital data having blue image information (gray-scale information) (FIG. 7B) is described. The conversion of the n bit digital data having blue image information is similar to the conversion of the n bit digital data having green image information. Bn+1 (=0) is added above the most significant bit among the n bit digital data (Bn (MSB), Bn−1, . . . , B3, B2, and B1 (LSB)) having blue image information. In other words, Bn+1 (=0) to serve as the most significant bit is added to the n bit digital data (Bn (MSB), Bn−1, . . . , B3, B2, and B1 (LSB)) having blue image information. It is to be noted that the n bit digital data before the conversion (Bn (MSB), Bn−1, . . . , B3, B2, and B1 (LSB)) is used as the lower n bits of the (n+1) bit digital data after the conversion. In this way, the n bit digital data having blue image information is converted into the (n+1) bit digital data in which the value of the most significant bit (MSB) is "0".

As described in the above, the respective red, green, and blue n bit digital data are converted into (n+1) bit digital data.

By carrying out such digital data conversion, as shown in FIG. 2A, the digital data having red image information presents the lowest luminance (here, 0) at the lowest gray-scale level (here, gray-scale level $2^1=2$), and presents the highest luminance $B_{Rmax}$ at the highest gray-scale level (here, gray-scale level $2^{n+1}$). Display of $2^n$ gray-scales from gray-scale level 2 to gray-scale level $2^{n+1}$ can be carried out with two gray-scales as one step and with the luminance being from the lowest luminance to the highest luminance $B_{Rmax}$.

As shown in FIG. 2B, the digital data having green image information presents the lowest luminance (here, 0) at the lowest gray-scale level (here, gray-scale level $2^0=1$), and presents the highest luminance $B_{Rmax}$ at the highest gray-scale level (here, gray-scale level $2^n$). Here, the highest gray-scale level is $2^n$ because the value of the most significant bit becomes "0" through the above-described digital data conversion. In this way, display of $2^n$ gray-scales from gray-scale level 1 to gray-scale level $2^n$ can be carried out with the luminance being from the lowest luminance to the highest luminance $B_{Rmax}$.

As shown in FIG. 2B, the digital data having blue image information presents the lowest luminance (here, 0) at the lowest gray-scale level (here, gray-scale level $2^0=1$), and presents the highest luminance $B_{Rmax}$ at the highest gray-scale level (here, gray-scale level $2^n$). Here, similar to the case of green, the highest gray-scale level is $2^n$ because the most significant bit of the data becomes "0" through the above-described digital data conversion. In this way, display of $2^n$ gray-scales from gray-scale level 1 to gray-scale level $2^n$ can be carried out with the luminance being from the lowest luminance to the highest luminance $B_{Rmax}$.

Therefore, all of the highest luminance of red, the highest luminance of green, and the highest luminance of blue are the highest luminance $B_{Rmax}$ of red, and thus, display can be carried out with the luminance of red, the luminance of green, and the luminance of blue being well-balanced.

Now, operation from inputting the digital data to the EL display device to displaying an image display in the driving method according to the present invention is described with reference to FIG. 4. Though a case where image information is provided as 7 bit digital data is described here as an example, the present invention is not limited thereto.

First, one frame of an image is divided into seven subframes. It is to be noted that one cycle for inputting data to all the pixels in a display region of an EL display device is referred to as one frame. In a typical EL display device, the frequency is 60 Hz. In other words, 60 frames are formed in one second. If the number of frames formed in one second is less than 60, flicker of an image is visually conspicuous. It is to be noted that a plurality of divisions of one frame are referred to as subframes.

One subframe can be broken down into an address time period (Ta) and a sustain time period (Ts). An address time period is the whole time period necessary for inputting data to all the pixels in one subframe. A sustain time period (which may be called also as a lighting time period) is a time period during which the EL elements emit light.

Here, the first subframe is denoted as SF1, and the second to the seventh subframes are denoted as SF2–SF7, respectively. The address time period (Ta) is constant with regard to all of SF1–SF7. On the other hand, the sustain time period (Ts) of SF1–SF7 are denoted as Ts1–Ts7, respectively. It is to be noted that the display of SF1 corresponds to the most significant bit while the display of SF7 corresponds to the least significant bit.

Here, the sustain time periods are set such that Ts1:Ts2:Ts3:Ts4:Ts5:Ts6:Ts7=1:½:¼:⅛:1/16:1/32:1/64. It is to be noted that the order of appearance of SF1–SF8 is arbitrary. By combining these sustain time periods, desired gray-scale display among the 128 gray-scale levels can be carried out.

It is to be noted that, in the method of driving an EL display device according to the present invention, since the least significant bit of digital data having red image information is always "1", the most significant bit of digital data having green image information is always "0", and the most significant bit of digital data having blue image information is always "0", practically display of 64 gray-scales can be carried out with regard to each of red, green, and blue.

First, with an opposing electrode (an electrode which is not connected to TFTs, typically a cathode) of EL elements of pixels having no voltage applied thereto (being unselected), digital data is inputted to each of the pixels with the EL elements emitting no light. The time period to do this is an address time period. When digital data is inputted to all the pixels and the address time period ends, voltage is applied to the opposing electrode (the opposing electrode is selected) to make the EL elements emit light simultaneously. The time period to do this is a sustain time period. The time period to carry out the light emitting (to light the pixels) is any of the time periods Ts1–Ts7.

Then, an address time period again begins. After digital data is inputted to each of the pixels, a sustain time period begins. The sustain time period is any of the time periods Ts1–Ts7.

Similar operation is repeated with regard to the remaining five subframes, and predetermined pixels are lighted in the respective subframes.

One frame ends when seven subframes appear. Here, by accumulating the sustain time periods, the gray-scale of a pixel can be controlled and desired luminance can be realized.

In case n bit digital data is inputted from the external and is converted into (n+1) bit digital data as described in the above, first, one frame is divided into (n+1) subframes (denoted as SF1, SF2, SF3, . . . SF(n−1), SF(n), and SF(n+1)) so as to correspond to the (n+1) bits. As the number of the gray-scales increases, the number of divisions of one frame also increases, which makes it necessary to drive a driving circuit at a higher frequency.

Each of the (n+1) subframes can be broken down into an address time period (Ta) and a sustain time period (Ts). More specifically, by selecting whether voltage is applied to the opposing electrode common to all the EL elements or not, the address time period and the sustain time period are selected.

Then, processing is carried out to set the sustain time periods (Ts1, Ts2, Ts3, . . . Ts(n−1), Ts(n), and Ts(n+1) for SF1, SF2, SF3, . . . SF (n−1), SF(n), and SF (n+1), respectively) for the (n+1) subframes so that Ts1:Ts2:Ts3: . . :Ts(n−1)Ts(n):Ts(n+1)=$2^0$:$2^{-1}$:$2^{-2}$: . . . $2^{-(n-2)}$:$2^{-(n-1)}$:$2^{-n}$.

With this state, in one arbitrary subframe, pixels are sequentially selected (strictly speaking, TFTs for switching of the respective pixels are selected) to apply predetermined gate voltage (corresponding to a data signal) to gate electrodes of TFTs for current controlling). Here, an EL element of a pixel to which digital data to make conducting its TFT for current controlling is inputted emits light after an address time period ends for a sustain time period allotted to the subframe. In other words, predetermined pixels are lighted.

This operation is repeated with regard to each of the (n+1) subframes. By accumulating the sustain time periods, the gray-scales of the respective pixels can be controlled. When attention is focused on one arbitrary pixel, the gray-scale of the pixel is controlled depending on how long the pixel is lighted in the subframes (the number of sustain time periods the pixel goes through).

Hereinbelow, the structure of the present invention will be described in accordance with descriptions of claims.

An EL display device according to the present invention is characterized in that the device includes a circuit for converting n bit digital data having red image information, n bit digital data having green image information, and n bit digital data having blue image information (n is a natural number) inputted from the external into (n+1) bit digital data having red image information, (n+1) bit digital data having green image information, and (n+1) bit digital data having blue image information, respectively, and in that, by adding a bit having the value of one below the least significant bit of the n bit digital data having red image information, adding a bit having the value of zero above the most significant bit of the n bit digital data having green image information, and by adding a bit having the value of zero above the most significant bit of the n bit digital data having blue image information, the circuit produces the (n+1) bit digital data having red image information, the (n+1) bit digital data having green image information, and the (n+1) bit digital data having blue image information, respectively, to be used for displaying an image.

Further, a method of driving an EL display device according to the present invention is characterized in that the method comprises the steps of: adding a bit having the value of one below the least significant bit of n bit digital data having red image information inputted from the external; adding a bit having the value of zero above the most significant bit of n bit digital data having green image information inputted from the external; and adding a bit having the value of zero above the most significant bit of n bit digital data having blue image information inputted from the external, whereby producing (n+1) bit digital data having red image information, (n+1) bit digital data having green image information, and (n+1) bit digital data having blue image information, respectively; and inputting the (n+1) bit digital data having red image information, the (n+1) bit digital data having green image information, and the (n+1) bit digital data having blue image information to a time-division gray-scale data signal generating circuit, the time-division gray-scale data signal generating circuit dividing one frame into (n+1) subframes (SF1, SF2, SF3, . . . SF (n−1), SF(n), and SF (n+1)) and selecting an address time period ($T_a$) and a sustain time period (Ts1, Ts2, Ts3, Ts(n−1), Ts(n), and Ts(n+1) for SF1, SF2, SF3, SF (n−1), SF(n), and SF (n+1), respectively) for each of the (n+1) subframes, the sustain time periods for the (n+1) subframes being set so that Ts1:Ts2:Ts3: . . . :Ts(n−1):Ts(n):Ts(n+1)= $2^0$:$2^{-1}$:$2^{-2}$: . . . :$2^{-(n-2)}$:$2^{-(n-1)}$:$2^{-n}$.

DETAILED DESCRIPTION OF THE PREFERRED EMBODIMENT

An embodiment mode of the present invention will be described in the following.

Figure 1:
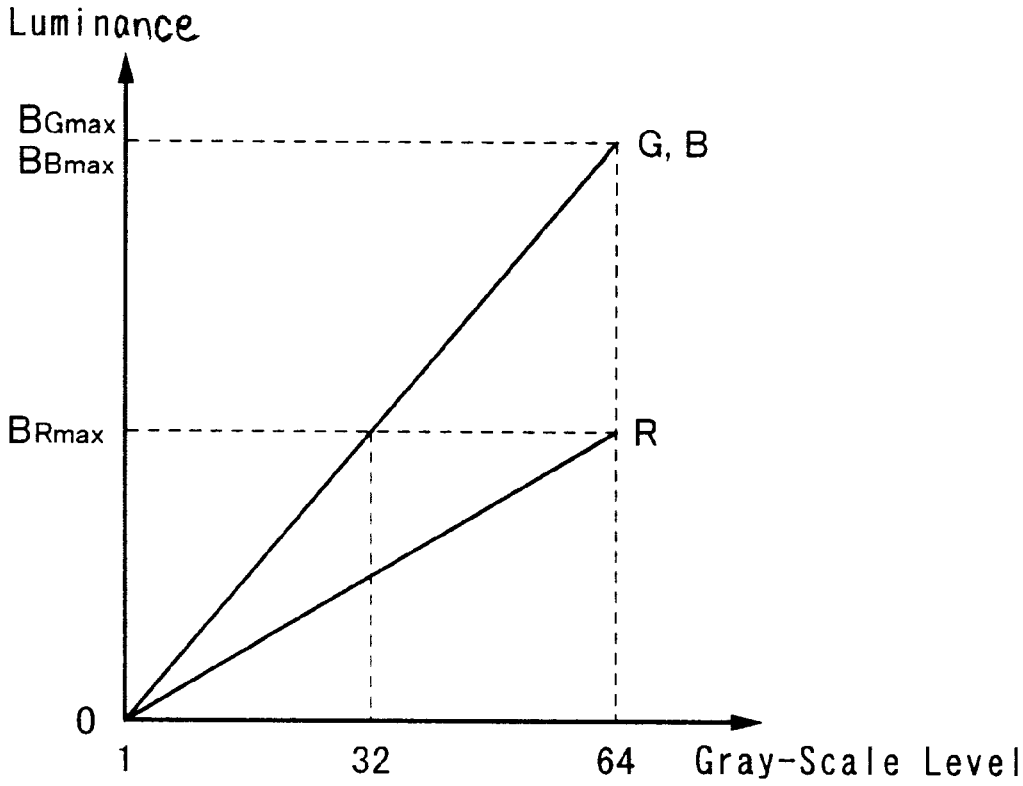
FIG. 1 is a graph showing the luminance of light emission with respect to gray-scale levels of an EL display device.
Figure 2A:
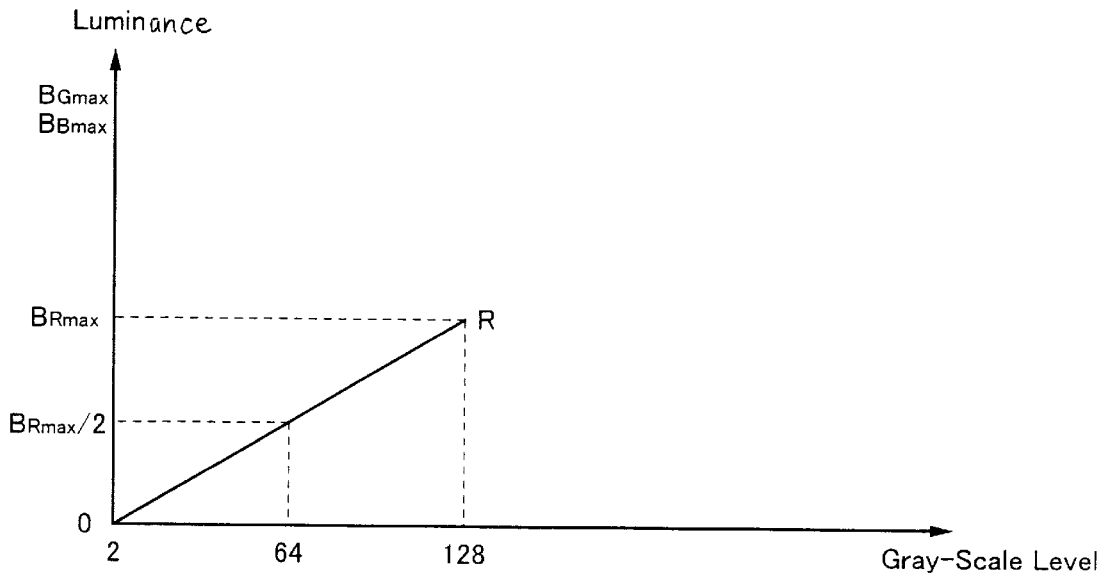
FIG. 2 is a graph showing the luminance of light emission with respect to gray-scale levels of an EL display device in accordance with the present invention.
Figure 2B:
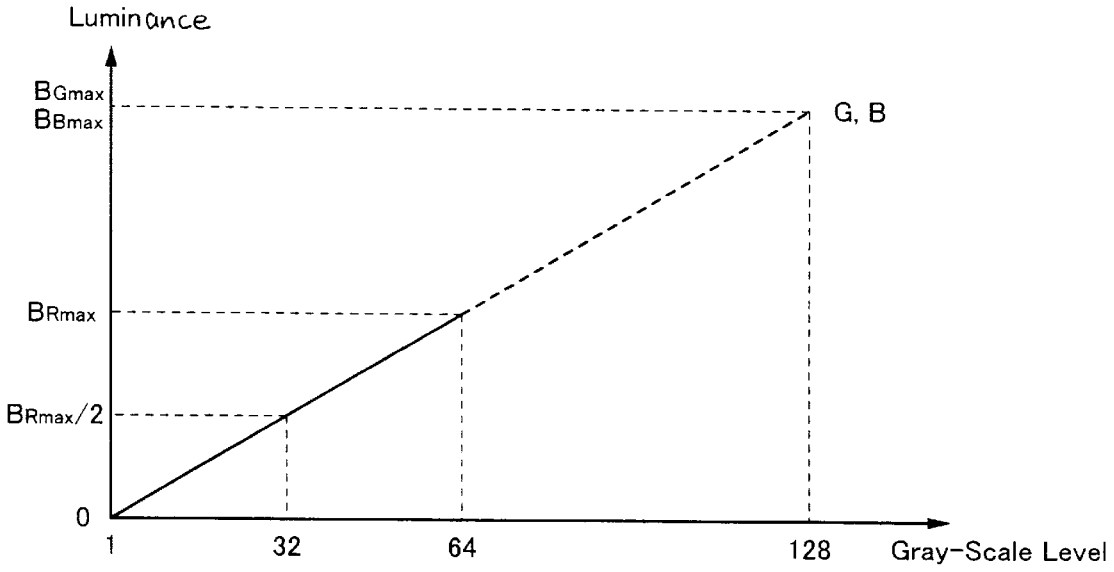
Figure 3:
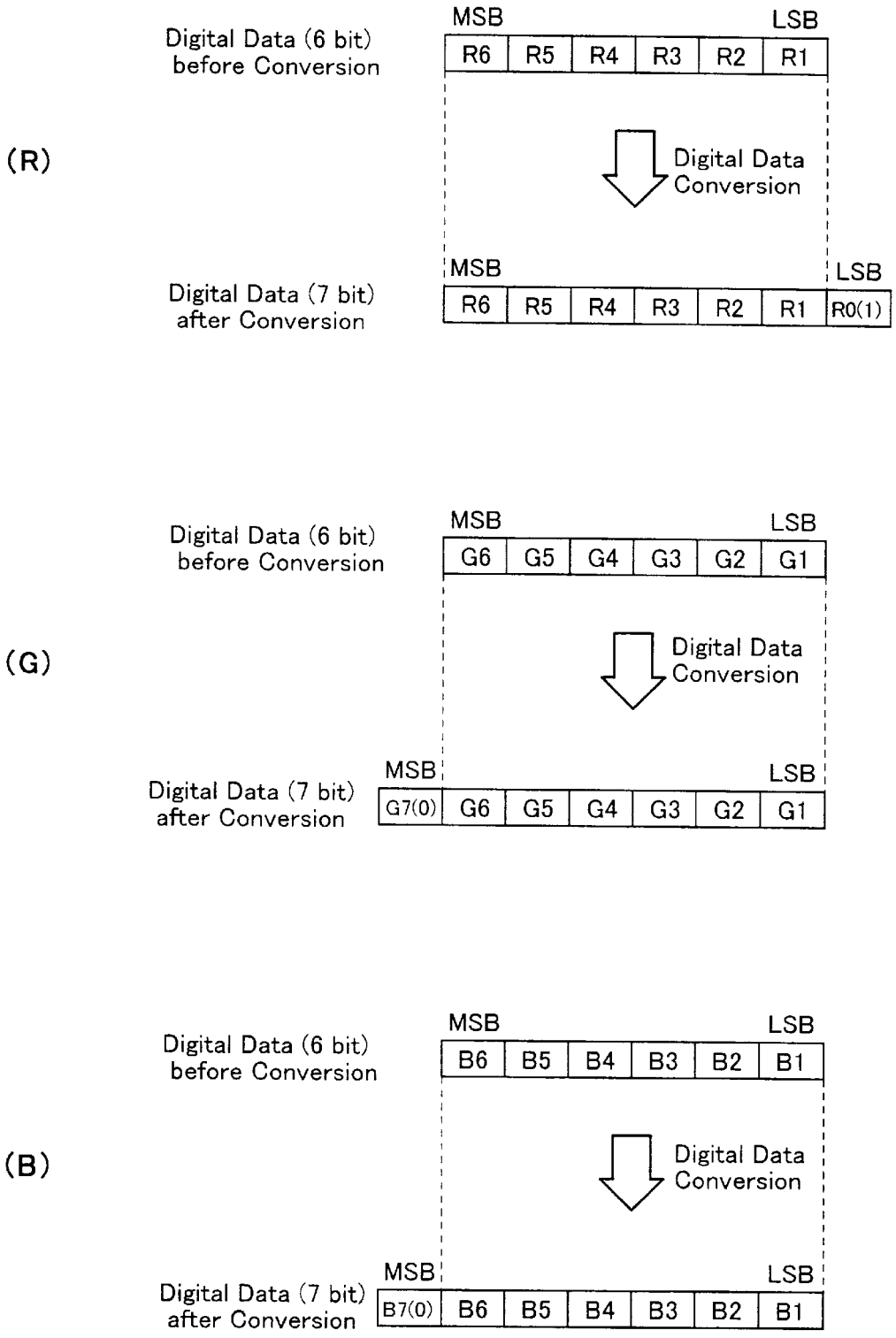
FIG. 3 illustrates a method of converting digital data in a method of driving the EL display device in accordance with the present invention.
Figure 4:
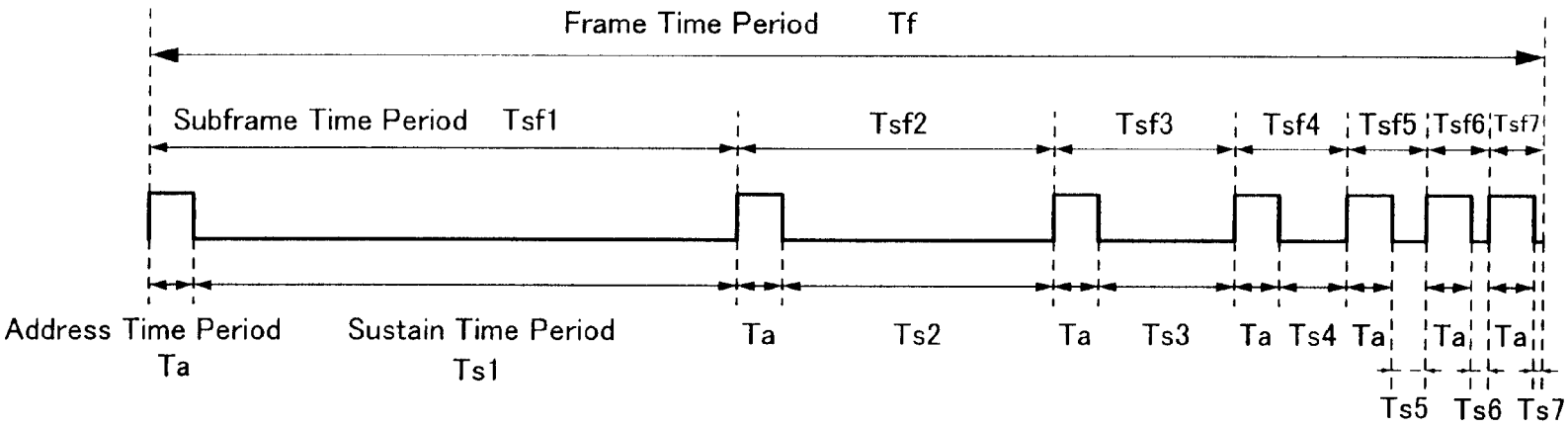
FIG. 4 is a timing chart of the method of driving the EL display device in accordance with the present invention.
Figure 5:
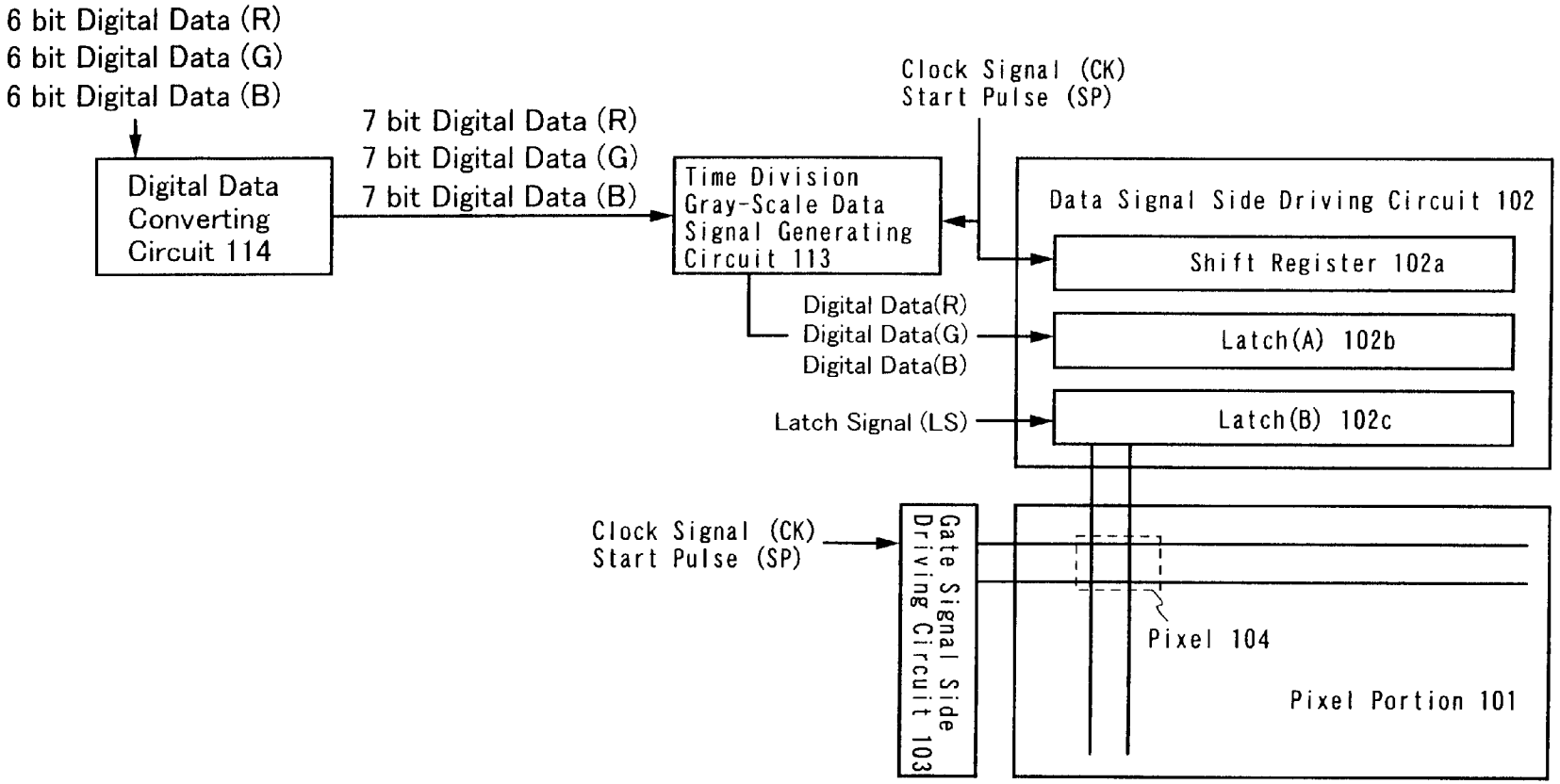
FIG. 5 is a schematic block diagram of the EL display device in accordance with the present invention.

Reference is made to FIG. 5, which is a schematic block diagram of an EL display device having a driving circuit, which employs a driving method in accordance with the present invention.

In the present embodiment mode, 6 bit digital data having red, green, and blue image information (gray-scale information), respectively, are inputted from the external. Note that, as described in the above, n bit digital data having red, green, and blue image information (gray-scale information), respectively, may also be inputted from the external.

First, in the EL display device according to the present invention shown in FIG. 5, a pixel portion 101, and, a driving circuit 102 on the side of data signals and a driving circuit 103 on the side of gate signals both of which are disposed on the periphery of the pixel portion 101, are formed with TFTs formed on a substrate. Note that a pair of such driving circuits 102 on the side of data signals may be provided so as to sandwich the pixel portion 101, and a pair of such driving circuits 103 on the side of gate signals may be provided so as to sandwich the pixel portion 101.

The driving circuit 102 on the side of data signals basically includes a shift register 102*a*, a latch (A) 102*b*, and a latch (B) 102*c*. A clock signal (CK) and a start pulse (SP) are inputted to the shift register 102*a*. Digital data (digital data (R), digital data (G), and digital data (B)) are inputted to the latch (A) 102*b*, and a latch signal is inputted to the latch (B) 102*c*.

In the present invention, data inputted to the pixel portion 101 is digital data. More specifically, digital data having information of either "0" or "1" is inputted as it is to the pixel portion 101.

Figure 6:
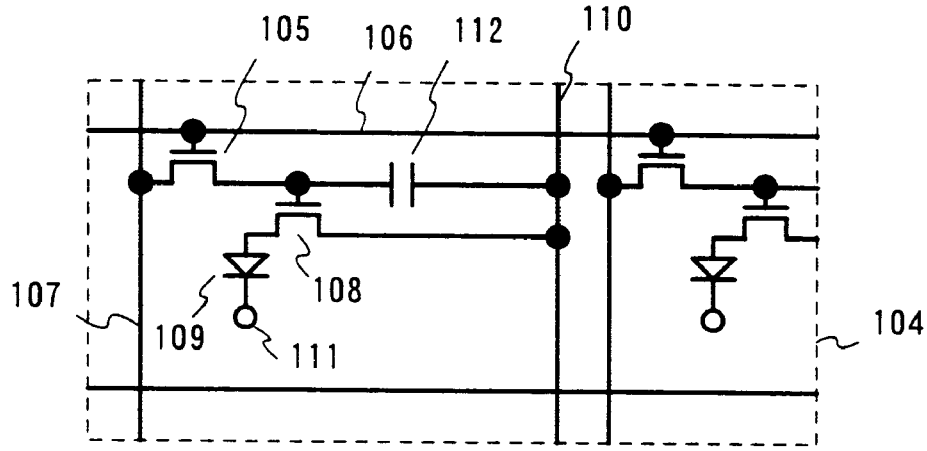
FIG. 6 is a circuit diagram of a pixel of the EL display device in accordance with the present invention.
Figure 7:
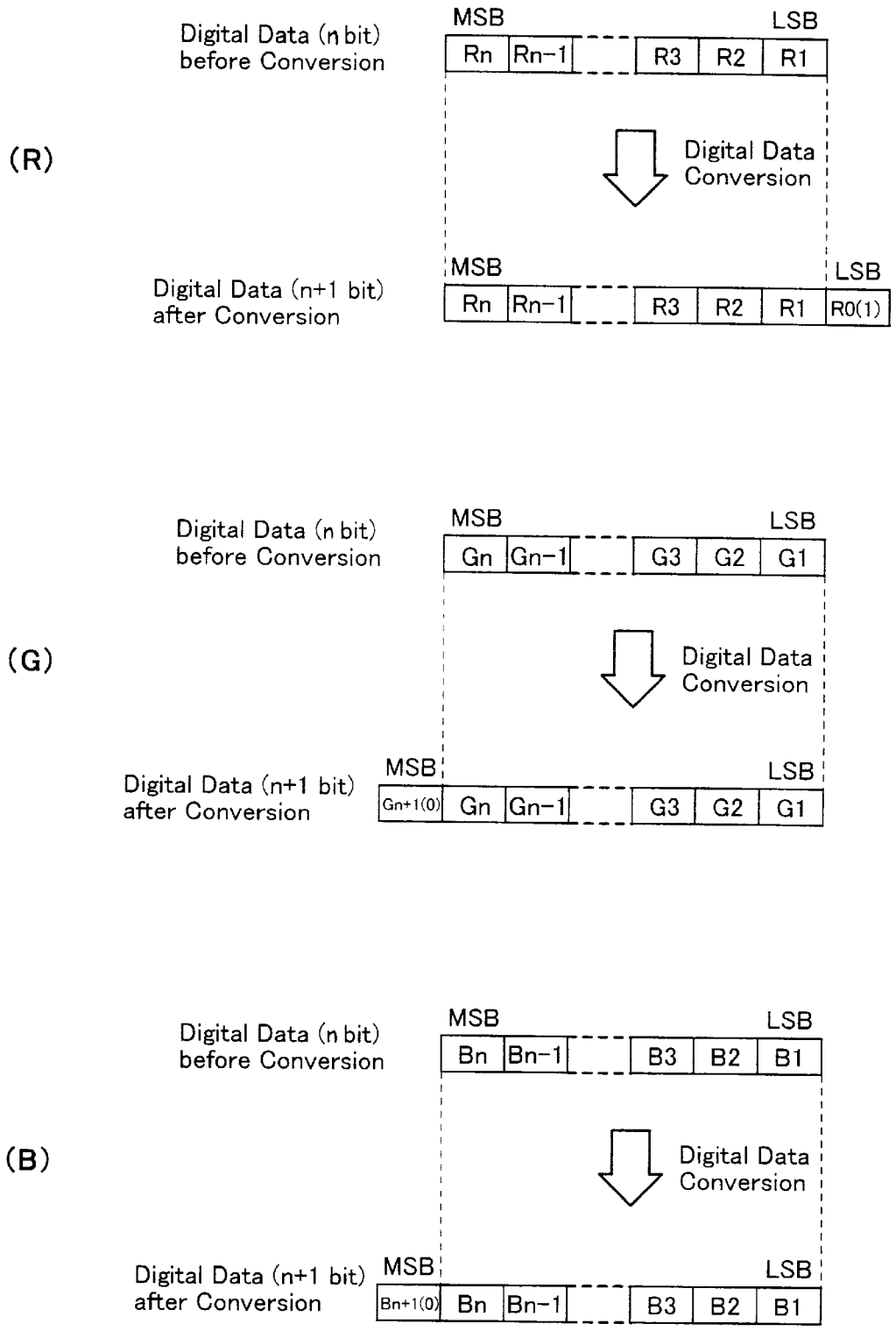
FIG. 7 illustrates a method of converting digital data in the method of driving the EL display device in accordance with the present invention.
Figure 8A:
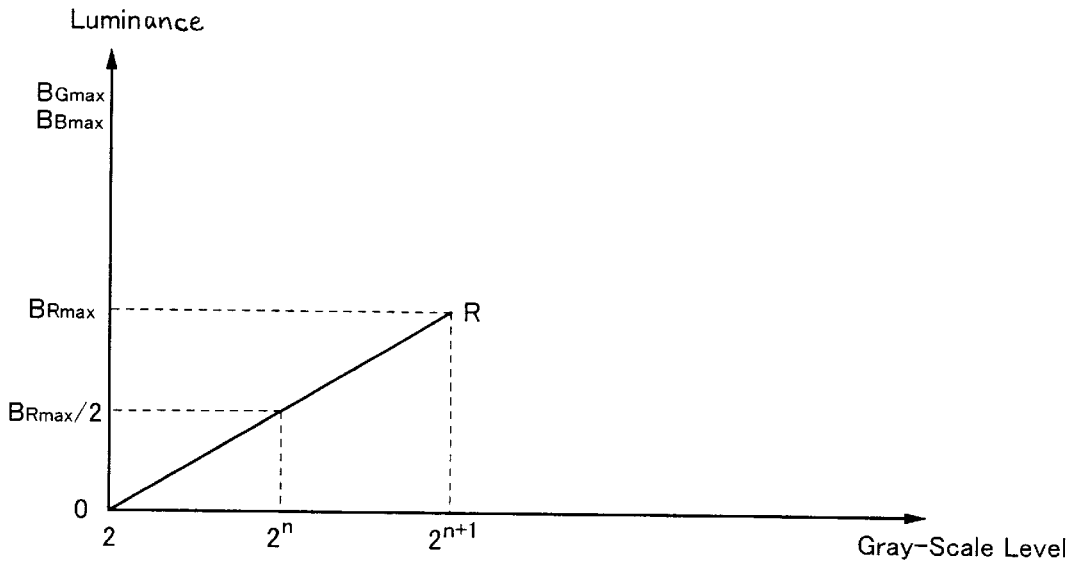
FIG. 8 is a graph showing the luminance of light emission with respect to gray-scale levels of the EL display device in accordance with the present invention.
Figure 8B:
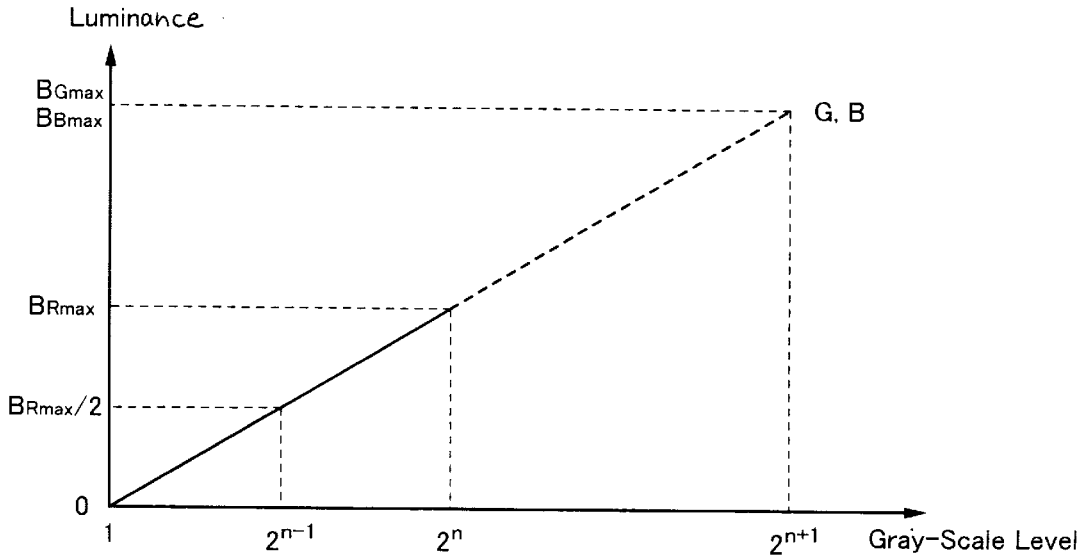

A plurality of pixels 104 are arranged in matrix in the pixel portion 101. FIG. 6 is an enlarged view of a pixel 104. In FIG. 6, a TFT 105 for switching is connected to a gate wiring 106 for inputting a gate signal and to a data wiring (also referred to as a source wiring) 107 for inputting a data signal.

A gate of a TFT 108 for current controlling is connected to a drain of the TFT 105 for switching. A drain of the TFT 108 for current controlling is connected to an EL element 109 while a source of the TFT 108 for current controlling is connected to a power source supply line 110. The EL element 109 is formed of an anode (a pixel electrode) connected to the TFT 108 for current controlling and a cathode (an opposing electrode) provided so as to oppose the anode with an EL layer sandwiched therebetween. The cathode is connected to a predetermined power source 111.

A capacitor 112 is provided to maintain the gate voltage of the TFT 108 for current controlling when the TFT 105 for switching is in an unselected state (OFF state). The capacitor 112 is connected to the drain of the TFT 105 for switching and to the power source supply line 110.

Digital data inputted to the pixel portion 101 structured as described in the above is produced by a time-division gray-scale data signal generating circuit 113 and a digital data converting circuit 114. 6 bit digital data (6 bit digital data (R), 6 bit digital data (G), and 6 bit digital data (B)) inputted from the external are converted into 7 bit digital data (7 bit digital data (R), 7 bit digital data (G), and 7 bit digital data (B)), respectively, by the digital data converting circuit 114. It is to be noted that the method of converting the digital data is as described in the above.

The 7 bit digital data (7 bit digital data (R), 7 bit digital data (G), and 7 bit digital data (B)) produced by the digital data converting circuit 114 are inputted to the time-division gray-scale data signal generating circuit 113. The time-division gray-scale data signal generating circuit 113 is a circuit for converting 7 bit digital data into digital data for carrying out time-division gray-scale and for generating a timing pulse and the like necessary for carrying out time-division gray-scale display. Here, the time-division gray-scale data signal generating circuit 113 comprises means for dividing one frame into seven subframes corresponding to the 7 bit gray-scales, means for selecting an address time period and a sustain time period for each of the seven subframes, and means for setting the sustain time periods such that $Ts1:Ts2:Ts3:Ts4:Ts5:Ts6:Ts7=1:\frac{1}{2}:\frac{1}{4}:\frac{1}{8}:\frac{1}{16}:\frac{1}{32}:\frac{1}{64}$.

It is to be noted that, in case (n+1) bit digital data is inputted to the time-division gray-scale data signal generating circuit 113, the time-division gray-scale data signal generating circuit 113 comprises means for dividing one frame into (n+1) subframes corresponding to the (n+1) bit gray-scales, means for selecting an address time period and a sustain time period for each of the (n+1) subframes, and means for setting the sustain time periods so that $Ts1:Ts2:Ts3:\ldots:Ts(n-1):Ts(n):Ts(n+1)=2^0:2^{-1}:2^{-2}:\ldots:2^{-(n-2)}:2^{-(n-1)}:2^{-n}$.

The time-division gray-scale data signal generating circuit 113 may be provided outside the EL display device according to the present invention. In this case, digital data formed there is structured to be inputted to the EL display device according to the present invention. In this case, an electronic apparatus having as its display the EL display device according to the present invention includes the EL display device according to the present invention and the time-division gray-scale data signal generating circuit as different parts.

Further, the time-division gray-scale data signal generating circuit 113 may be mounted in the form of an IC chip or the like on the EL display device according to the present invention. In that case, digital data formed by the IC chip is structured to be inputted to the EL display device according to the present invention. In this case, an electronic apparatus having as its display the EL display device according to the present invention includes as its part the EL display device according to the present invention having the IC chip including the time-division gray-scale data signal generating circuit 113 mounted thereon.

Still further, ultimately, the time-division gray-scale data signal generating circuit 113 can be formed with a TFT on the substrate having the pixel portion 104, the driving circuit 102 on the side of data signals, and the driving circuit 103 on the side of gate signals formed thereon. In this case, by inputting to the EL display device digital video data including image information, all the processing can be carried out on the substrate.

EMBODIMENT 1

The EL display device using the driving method according to the present invention (hereinafter referred to as "the EL display device according to the present invention") can be incorporated into various electronic equipment to be used.

Such electronic equipment include a video camera, a digital camera, a head-mounted display (a goggle-type display), a game machine, a car navigation system, a personal computer, a personal digital assistant (such as a mobile computer, a portable telephone, or an electronic book). FIG. 9 shows examples of such electronic equipment.

Figure 9A:
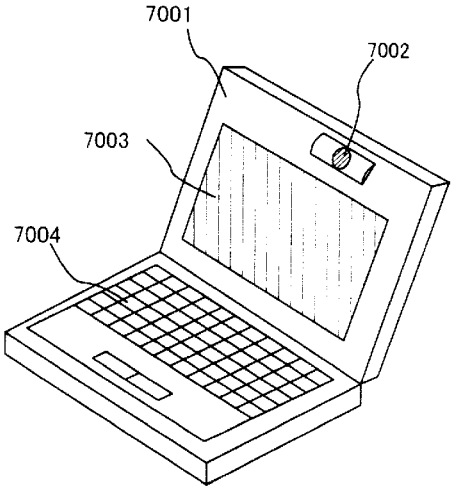
FIG. 9 shows examples of electronic equipment using the EL display device in accordance with the present invention.

FIG. 9A shows a personal computer formed of a main body 7001, an image input portion 7002, an EL display device 7003 according to the present invention, and keyboard 7004.

Figure 9B:
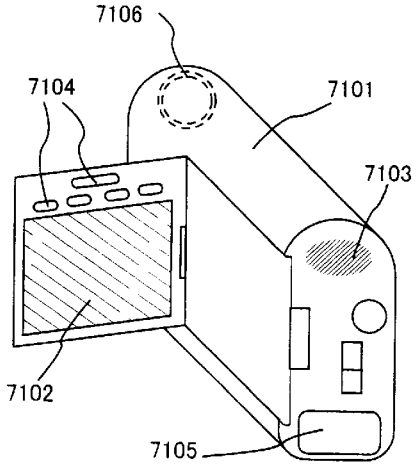

FIG. 9B shows a video camera formed of a main body 7101, an EL display device 7102 according to the present invention, a voice input portion 7103, a control witch 7104, a battery 7105, and an image receiving portion 7106.

Figure 9C:
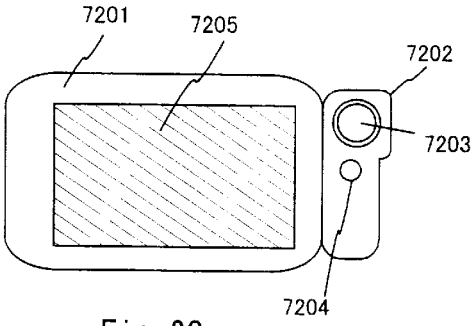

FIG. 9C shows a mobile computer formed of a main body 7201, a camera portion 7202, an image receiving portion 7203, a control switch 7204, and an EL display device 7205 according to the present invention.

Figure 9D:
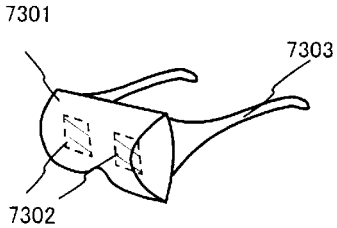

FIG. 9D shows a goggle-type display formed of a main body 7301, an EL display device 7302 according to the present invention, and an arm portion 7303.

Figure 9E:
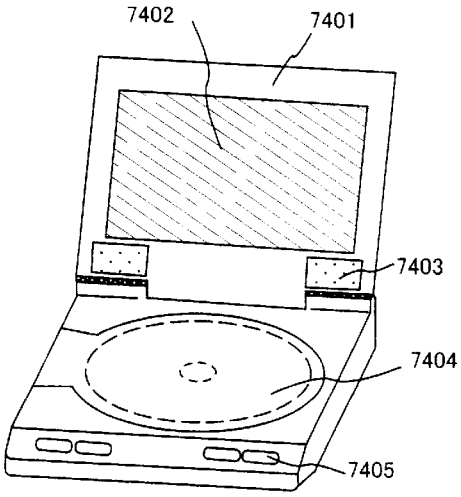

FIG. 9E shows a player using a recording medium with a program recorded thereon (hereinafter referred to as a recording medium) formed of a main body 7401, an EL display device 7402 according to the present invention, a speaker portion 7403, a recording medium 7404, and a control switch 7405. It is to be noted that the apparatus uses a DVD (digital versatile disc), a CD, or the like as the recording medium. With the apparatus, one can enjoy music, a movie, a game, or the Internet.

Figure 9F:
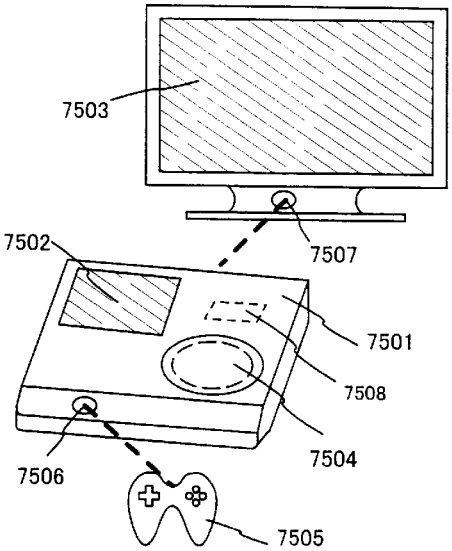

FIG. 9F shows a game machine formed of a main body 7501, an EL display device 7502 according to the present invention, another EL display device 7503 according to the present invention, a recording medium 7504, a controller 7505, a sensor portion 7506 for the main body, a sensor portion 7507, and a CPU portion 7508. The sensor portion 7506 for the main body and the sensor portion 7507 can sense infrared radiation emitted from the controller 7505 and the main body 7501, respectively.

As described in the above, the application of the EL display device according to the present invention is very wide, and the EL display device can be applied to electronic apparatus of all fields.

According to the present invention, the white balance can be improved to carry out satisfactory display even with regard to an EL display device using an EL light emitting layer with low luminance of red light emission.

What is claimed is:

1. An EL display device comprising:

a circuit for converting n bit digital data having red image information, n bit digital data having green image information, and n bit digital data having blue image information (n is a natural number) inputted from the external into (n+1) bit digital data having red image information, (n+1) bit digital data having green image information, and (n+1) bit digital data having blue image information, respectively, wherein said circuit produces said (n+1) bit digital data having red image information, said (n+1) bit digital data having green image information, and said (n+1) bit digital data having blue image information by adding a bit having the value of one below the least significant bit of said n bit digital data having red image information, a bit having the value of zero above the most significant bit of said n bit digital data having green image information, and a bit having the value of zero above the most significant bit of said n bit digital data having blue image information, respectively.

2. An EL display device according to claim 1, wherein said EL display device is incorporated into an electronic equipment selected from the group consisting of a video camera, a digital camera, a head-mounted display, a game machine, a car navigation system, a personal computer, a mobile computer, a portable telephone and an electric book.

3. A method of driving an EL display device comprising the steps of:

adding a bit having the value of one below the least significant bit of n bit digital data having red image information inputted from the external;

adding a bit having the value of zero above the most significant bit of n bit digital data having green image information inputted from the external; and adding a bit having the value of zero above the most significant bit of n bit digital data having blue image information inputted from the external, whereby producing (n+1) bit digital data having red image information, (n+1) bit digital data having green image information, and (n+1) bit digital data having blue image information, respectively; and inputting said (n+1) bit digital data having red image information, said (n+1) bit digital data having green image information, and said (n+1) bit digital data having blue image information to a time-division gray-scale data signal generating circuit, said time-division gray-scale data signal generating circuit dividing one frame into (n+1) subframes (SF1, SF2, SF3, . . . SF (n−1), SF(n), and SF (n+1)) and selecting an address time period ($T_a$) and a sustain time period (Ts1, Ts2, Ts3, . . . Ts(n=1), Ts(n), and Ts(n+1) for SF1, SF2, SF3, . . . SF (n−1), SF(n), and SF (n+1), respectively) for each of said (n+1) subframes, said sustain time periods for said (n+1) subframes being set so that Ts1:Ts2:Ts3: . . . :Ts(n−1):Ts(n):Ts(n+1)=$2^0$:$2^{-1}$:$2^{-2}$: . . . :$2^{-(n-2)}$:$2^{-(n-1)}$:$2^{-n}$.

4. An EL display device, which employs a driving circuit having a driving method according to claim 3.

5. An EL display device according to claim 3, wherein said EL display device is incorporated into an electronic equipment selected from the group consisting of a video camera, a digital camera, a head-mounted display, a game machine, a car navigation system, a personal computer, a mobile computer, a portable telephone and an electric book.

6. A method of driving an EL display device comprising the steps of:

adding a bit having the value of one below the least significant bit of n bit digital data having red image information inputted from the external;

adding a bit having the value of zero above the most significant bit of n bit digital data having green image information inputted from the external; and adding a bit having the value of zero above the most significant bit of n bit digital data having blue image information inputted from the external, whereby producing (n+1) bit digital data having red image information, (n+1) bit digital data having green image information, and (n+1) bit digital data having blue image information, respectively.

7. An EL display device, which employs a driving circuit having a driving method according to claim 6.

8. An EL display device according to claim 6, wherein said EL display device is incorporated into an electronic equipment selected from the group consisting of a video camera, a digital camera, a head-mounted display, a game machine, a car navigation system, a personal computer, a mobile computer, a portable telephone and an electric book.

9. An EL display device comprising:

a circuit for converting n bit digital data having red image information, n bit digital data having green image information, and n bit digital data having blue image information (n is a natural number) inputted from the external into (n+1) bit digital data having red image information, (n+1) bit digital data having green image information, and (n+1) bit digital data having blue image information, respectively; and a time-division gray-scale data signal generating circuit for dividing one frame into (n+1) subframes (SF1, SF2, SF3, . . . SF (n−1), SF(n), and SF (n+1)) and selecting an address time period (Ta) and a sustain time period (Ts1, Ts2, Ts3, Ts(n−1), Ts(n), and Ts(n+1) for SF1, SF2, SF3, . . . SF (n−1), SF(n), and SF (n+1), respectively) for each of said (n+1) subframes, said sustain time periods for said (n+1) subframes being set so that Ts1:Ts2:Ts3: . . . :Ts(n−1):Ts(n):Ts(n+1)=$2^0$:$2^{-1}$:$2^{-2}$: . . . :$2^{-(n-2)}$:$2^{-(n-1)}$:$2^{-n}$, wherein said circuit produces said (n+1) bit digital data having red image information, said (n+1) bit digital data having green image information, and said (n+1) bit digital data having blue image information by adding a bit having the value of one below the least significant bit of said n bit digital data having red image information, a bit having the value of zero above the most significant bit of said n bit digital data having green image information, and a bit having the value of zero above the most significant bit of said n bit digital data having blue image information, respectively.

10. An EL display device according to claim 9, wherein said EL display device is incorporated into an electronic equipment selected from the group consisting of a video camera, a digital camera, a head-mounted display, a game machine, a car navigation system, a personal computer, a mobile computer, a portable telephone and an electric book.

* * * * *